1/7/86 XR 4,563,613

United States Patent [19]

Genovese et al.

[11] Patent Number: 4,563,613

[45] Date of Patent: Jan. 7, 1986

[54] GATED GRID STRUCTURE FOR A VACUUM FLUORESCENT PRINTING DEVICE

[75] Inventors: Frank C. Genovese, Fairport; James W. Lannom, Webster; Joel M. Pollack, Rochester, all of N.Y.

[73] Assignee: Xerox Corporation, Stamford, Conn.

[21] Appl. No.: 605,729

[22] Filed: May 1, 1984

[51] Int. Cl.[4] ..... H01J 1/62; H01J 63/04

[52] U.S. Cl. ..... 313/497; 313/422; 313/495

[58] Field of Search ..... 313/495, 422, 584, 475, 313/474, 470, 496, 497; 250/227

[56] References Cited

U.S. PATENT DOCUMENTS

| | | | |
|---|---|---|---|
| 3,646,382 | 2/1972 | Goede et al. | 313/104 |
| 3,890,609 | 6/1975 | Sasaki et al. | 313/584 |
| 3,935,500 | 1/1976 | Oess et al. | 313/495 |
| 3,936,697 | 2/1976 | Scott | 315/12 R |
| 4,121,129 | 10/1978 | Maloney | 313/584 |
| 4,134,668 | 1/1979 | Coburn | 355/3 R |
| 4,223,244 | 9/1980 | Kishino et al. | 313/497 |
| 4,227,117 | 10/1980 | Watanabe et al. | 315/13.1 |
| 4,291,341 | 9/1981 | Yajima | 358/300 |

FOREIGN PATENT DOCUMENTS 55-168961 12/1980 Japan .

OTHER PUBLICATIONS

1980 Futaba Corporation Catalog.

Mini-Micro World/Mini-Micro Systems; May 1983; pp. 56, 58, 64.

*Primary Examiner*—David K. Moore

*Attorney, Agent, or Firm*—William A. Henry, II

[57] ABSTRACT

A vacuum fluorescent printing device is disclosed having cathode filaments, a plurality of multiplexed control grids and a skewed matrix of addressable phosphor elements configured on an anode in such a fashion as to enable convenient electrical connection plus imagewise recombination of emitted light from said phosphor elements into a high resolution array for the purpose of directing this collection of addressable points of light onto a single line of a photoreceptor drum or belt thereby enabling a xerographic image to be generated. An equipotential screen grid is located between one of said plurality of grids and the anode in order to reduce voltage swings needed for cutoff of either grid for phosphor addressing purposes.

16 Claims, 2 Drawing Figures

GATED GRID STRUCTURE FOR A VACUUM FLUORESCENT PRINTING DEVICE

Reference is hereby made to copending applications Ser. No. 605,728, entitled "Vacuum Fluorescent Printing Device", Ser. No. 605,730, entitled "Edge-Out Matrix Light Bar Coupling Apparatus and Method Using a Fiber-Optics Plate", and Ser. No. 605,731, entitled "Vacuum Fluorescent Printing Device Employing a Fly's-Eye Light Coupling Method", filed concurrently herewith and incorporated by reference to the extent necessary to practice the present invention.

This invention relates to a printing device for exposing a photosensitive member and, more particularly, to an active light bar which creates precisely controlled marks on a photosensitive member from a digital electronic bit stream that represents a document of which a copy is desired.

Typical medium-to-high quality electronic printing systems have resolutions of 300 pixels (picture elements) per inch or more. Usually the resolution or pixel density is the same in both directions on the page, but this is not necessarily the case for all systems. Each bit of the electronic image is mapped to its appropriate pixel location on a grid that covers the page and defines the resolution of the system. The size of the mark that is made at each location depends on the particular marking process being used and may be smaller, but is usually larger, than the addressability of the system. For example, a round laser dot with a diameter of 1/300 inch may be used for exposure in a system with addressable elements arranged in a square array on 1/400 inch centers. With a raster scan, the information transfer is continuous, a bit at a time within each scan line being supplied, one line after another in linear succession. However, in principle, the order of mapping pixels is perfectly arbitrary. The choice usually depends wholly on practical considerations.

For an active light bar of a given resolution, the printing speed fixes the maximum time available to make the exposure and the sensitivity of the photosensitive member determines the maximum output power required. For example, if 6 ergs/cm$^2$ is needed for proper exposure of the photosensitive member, a 10 inch width processed at 10 inches per second requires a minimum of 3871 ergs/sec or 0.387 milliwatts delivered to its surface. The process time per pixel mapped one-at-a-time at 300×300 per inch is only 111 nanoseconds.

When the system permits many points to be mapped simultaneously, these stringent time restraints are relaxed. Data processed in parallel can be handled by slower, less expensive logic and circuits in general are much easier to design for low speed applications. The average power output of an individual element is reduced significantly when multiple elements can be used in parallel. The greater the number of sources that contribute to the net output, the greater the total available light and the longer the potential life of an individual element.

The following disclosures of various approaches to controlling display devices appear to be relevant:

U.S. Pat. No. 3,646,382

Patentee: Goede et al.

Issued: Feb. 29, 1972

Goede et al. discloses an electron beam scanning device for symbol and graphical information comprising a plurality of control plates sandwiched between an area electron source and a target. The control plates have apertures formed therein with the apertures of successive plates being aligned to form a plurality of electron channels between the electron source and the target.

U.S. Pat. No. 3,935,500

Patentee: Oess et al.

Issued: Jan. 27, 1976

Oess et al. discloses a flat cathode ray tube device provided for display of information by response to an electron beam off a phosphor coating on a face plate. A monolithic structure includes an x-y matrix of electron source cathodes and a pair of grid arrays successively spaced from the matrix with holes therethrough adjacent to and aligned with the cathodes selectively to form and individually control the intensity of an electron beam from each of the cathodes.

U.S. Pat. No. 3,936,697

Patentee: Scott

Issued: Feb. 3, 1976

Scott discloses a charged particle beam scanning device comprised of a plurality of control plates sandwiched between a cathode and a target to control the flow of charged particles such as electrons and ions between the cathode and the target. Each control plate has a plurality of apertures formed therein which are effectively aligned with corresponding apertures on the other control plates. The aligned apertures form beam channels. The control plates have paired conductive electrodes thereon arranged at predetermined coated finger patterns.

U.S. Pat. No. 4,223,244

Patentee: Kishino et al.

Issued: Sept. 16, 1980

Kishino et al. discloses a fluorescent display device having pattern display sections each composed of phosphor-coated anodes arranged in the form of a matrix, a filament for emitting electrons when heated with the anodes being selectively bombarded with electrons emitted from the cathode to produce a visual display. Position selecting grids are provided between the filament and the pattern display sections while column-selecting grids and row-selecting grids are provided opposite to the columns or rows of the anodes, and a frame member.

In addition, Ricoh's Japanese Laid-Open Patent Application No. 55-168961/1980 filed under the title "Light Emission Recording Tube" discloses a light tube that is used to transmit light to a photosensitive member and the publication Mini-Micro World/Mini-Micro Systems of May 1983 on pages 56, 58 and 64 discloses a method of imaging with staggered arrays of recording heads. All of the aforegoing disclosures are incorporated herein by reference.

It is known that CRT's such as shown in U.S. Pat. Nos. 4,134,668 and 4,291,341 can be used in several configurations to generate xerographic images. They can be addressed rapidly and emit sufficient light to expose existing photoreceptors even at relatively high speed and still be gated within the available time. However, they are bulky and expensive and require complex support circuitry. The dynamics of electron-beam deflection makes it difficult to produce light patterns that are bright, very high in resolution, exactly rectilinear, and very stable in location, all at the same time.

An invention that addresses these problems is disclosed in copending U.S. application Ser. No. 605,728 entitled "Vacuum Fluorescent Printing Device Employing a Fly's-Eye Light Coupling Method". In one aspect of that invention a vacuum fluorescent device with grids for addressing a phosphor coated anode is disclosed. If grids in the path from a cathode to anode are biased off, no current can flow and, therefore, no light will be generated and if the device is operated at a very high anode potential, the voltage swing needed for cutoff of the grids will be proportionately larger. This situation becomes particularly severe for a compact device where the spacing between the anode and grid structure is small.

The optical image bar of the present invention, therefore, includes an improvement that addresses the need for reducing voltage swings for control grids and comprises an anode support substrate on which skewed phospor coated anode segments or sections are positioned. Control grids are placed over the anode sections to gate emissions from cathode filaments spaced above the grids. The voltage swings needed for gating the control grids are significantly reduced by placing an equipotential screen grid between the anode substrate and the control grid structure. A second equipotential screen grid may be placed between the cathode filaments and the control grid structure to further reduce the voltage swings needed for gating the control grids. This screen also serves to reduce crosstalk between grids, that is, the effect on the electron flow at one grid location due to potentials applied to grids at other locations. A cover plate having either a transparent or opaque conductive coating on its inside surface mates with the anode substrate to form a hermetically sealed unit. The conductive coating is grounded to prevent charging of the inner surface of the cover plate. A coating that is transparent is preferred since visual observation during assembly simplifies certain fabrication steps. Electrons emitted from the cathode filaments are gated by the grid structure and excite the phosphor coated anode sections which in turn expose the photosensitive member through a lens or other means.

In another aspect of the invention, a small and compact print bar is disclosed that comprises dual controlled grids allowing "AND" gate addressing of both grid elements at low voltage while the anode is held constant at high voltage. This is an alternative to the presently used method of controlling vacuum-fluorescent devices using addressing of a screen (grid) electrode at low voltage, and direct addressing for the phosphor coated anode segments. Direct anode addressing has the important disadvantage that the switching apparatus must be able to handle the anode operating voltage. Increasing the anode voltage above a few hundred volts to increase phosphor brightness makes direct addressing with transistorized switching circuits impractical. Anode voltage is unrestricted with the present invention; although adding complexity to the grid structure, the design enables addressing both grid control elements forming the "AND" function at low voltage and also simplifies the anode structure (a solid area anode can be used without subdivisions).

Further features and advantages of the invention pertain to the particular apparatus whereby the above-noted aspects of the invention are obtained. Accordingly, the invention will be both understood by reference to the following description, and to the drawings forming a part thereof, which are approximately to scale, wherein.

Figure 1:
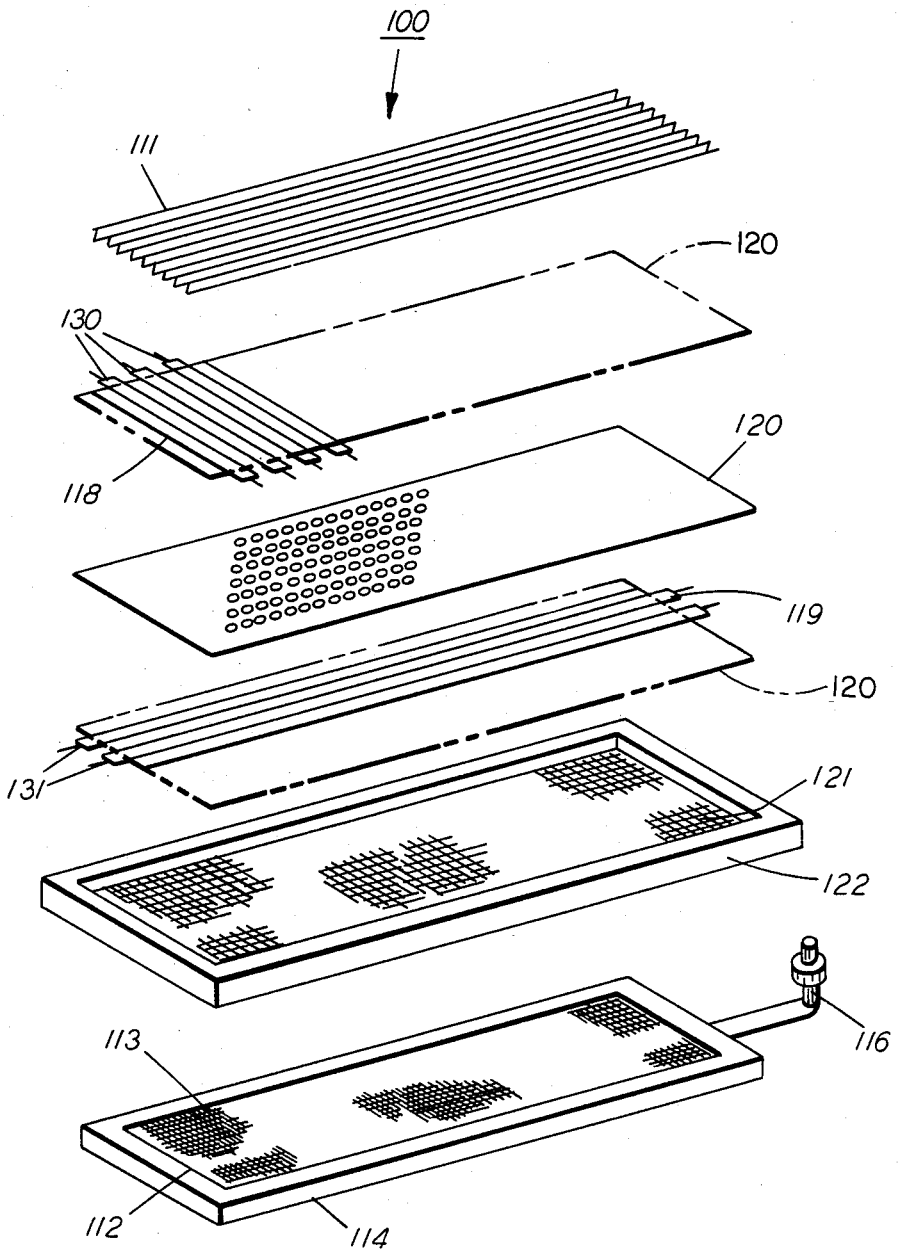
FIG. 1 is an exploded isometric view of the electrode structure of the present invention showing components thereof in their relative positions.

While the present invention will be described in a preferred embodiment, it will be understood that it is not intended to limit the invention to that embodiment. On the contrary, it is intended to cover all alternatives, modifications and equivalents as may be included within the spirit and scope of the inventions as defined by the appended claims.

The device that encompasses the present invention will now be described in detail with reference to the Figures where like reference numerals will be employed throughout to designate identical elements. Although the device for receiving electrical signals and generating an optical output is particularly well adapted for use in a printing machine, it should be evident from the following discussion that it is equally well suited for use in a wide variety of applications and is not necessarily limited to the particular embodiment disclosed.

In copending application U.S. application Ser. No. 605,728, a uniquely constructed vacuum fluorescent (VF) printing device with many controllable light emitting elements (segments) is disclosed for use as an image generating device in conjunction with light sensitive recording media in order to create electronically generated images on that medium. The device contains 4096 elements in a 16×256 matrix addressable array, 16 rows and 256 columns covering a photoreceptor width of 10.24 inches. This requires only 272 control line feedthrus which can be matrix controlled in a straightforward conventional way and can be easily incorporated in a tube envelope a little more than 12 inches in length. Light emitting segments are laid out in a skewed two-dimentional array so that there is enough room between elements to allow fabrication of the grid structure controlling the electron-beam of each element. Practical considerations limit the spacing of segments to approximately 15–20 mils.

VF devices are actually high vacuum cathode-ray tubes with multiple beams in which electrons emitted from a hot filament spanning the device can be gated by a grid structure to selectively excite segments of a phosphor coated anode screen. It can be appreciated that matrix control is necessary when the total number of connections needed for direct switching of 4000 to 6000 elements is considered. Many display and print bar technologies rely on non-linear behavior or incorporate external components to provide matrixing capability.

Vacuum tubes with multiple grids have this capability built in; if any grid in the path from the cathode to anode is biased off, no current can flow and, in the case of the CRT or VF device, no light will be generated. In these devices grid currents are normally very small and very little grid drive power is required. Since the actual amount of anode current is a continuous function of both grid potentials, the control voltage swings needed to provide strictly logical behavior depends on the particular device configuration and are a function of the grid spacings and shapes and the anode potential used. In general, the grid nearest the cathode is the most sensitive with greater voltage swings being required for successive grids in the path toward the anode. Raising the anode potential also increases the minimum voltage swings required for the system to behave as a logic circuit.

Referring now to FIG. 1, and in accordance with the present invention, a vacuum fluorescent device or optical light bar 100 is shown with many controllable light emitting areas or elements 113 on anode 112. The anode can be a thin phosphor layer of fluorescent material on a conducting substrate, a conducting equipotential coating on an insulating substrate that is covered with fluorescent material, or conducting anode areas positioned on an insulating anode substrate 114 and covered with a fluorescent substance. In each of these instances the phosphor layer can be either a continuous or a segmented coating. On the grid structure, orthogonal conductive traces or stripes 118 and 119 with electrical feed throughs 130 and 131 are arranged in rows and columns respectively, forming and x-y matrix. With this arrangement, the anode phosphor layer will be excited by the current of an electron beam from cathode filaments 111 passing through an aperture that has *both* row and column grids biased to conduct at that intersection. All other elements will remain "OFF". With one row grid held "ON", any number of elements along that row can be simultaneously excited by selecting the corresponding column grids. This mode of operation is important because more time is made available for exposing each point in the image when columns can be modulated simultaneously by parallel circuitry than is available when each element has to be excited by individual circuitry. At any one time, 256 pixels are addressed and may be exposed, depending on the image data which is presented to the column grids.

Figure 2:
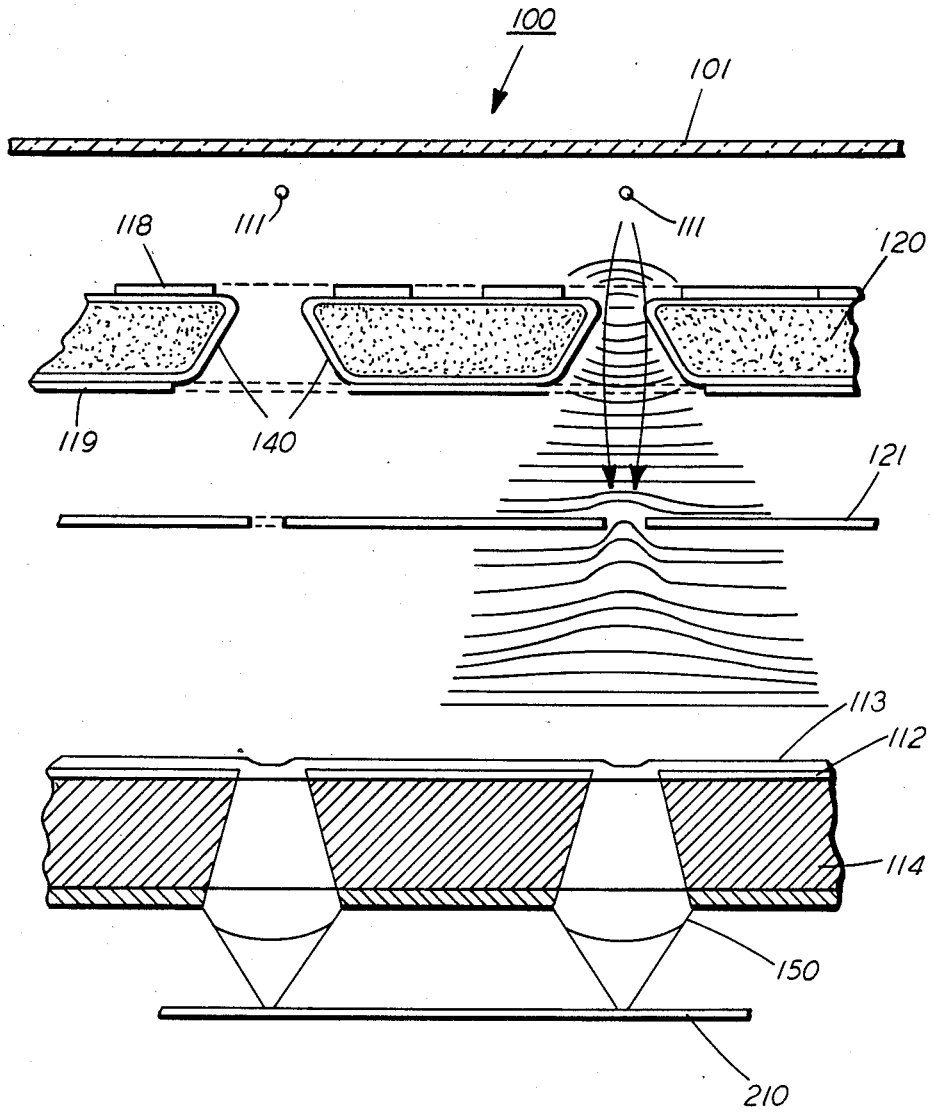
FIG. 2 is a partial edge view of an aspect of the present invention in a rear projection configuration employing a fly's-eye lens.

The optical imaging bar 100 includes a grid structure comprising a grid plate 120 consisting of an insulating sheet with an array of apertures having the same pattern on both sides and a condutive sheet 121 forming a screen having conductive patterns of holes. The grid plate 120 is a corning Photoform Opal lithium based glass ceramic product. This photoform glass product has the property of being easy to fabricate in a flat platform with complex holes. The screen is maintained at any positive voltage with the optimum valve of +5 up to +50 volts and is supported by a superstructure 122. A cover plate 101, shown in FIG. 2, provides with substrate 114 a high vacuum hermetically sealed unit. The optical imaging bar 100 is maintained air free by the use of a conventional getter. The grid plate is perforated with 4096 apertures in a staggered 256 column by 16 row array. Conductive traces are formed on both sides of the plate to make x-y connections to all the apertures. One side of the plate has 16 traces running the length of the plate, each electrically connected to 256 apertures, the other side has 256 traces across the width of the plate connecting 16 apertures each.

Optical light bar 100 is matrix controlled according to the truth table shown below and functions as a logical AND gate provided the control voltages $G_m$ and $G_n$ swing widely enough. In the table $G_m$ is one of grids 118, and $G_n$ is one of grids 119.

TRUTH TABLE

| $G_m$ | $G_n$ | $OUTPUT_{m,n}$* |
|---|---|---|
| low | low | off |
| low | high | off |
| high | low | off |

-continued

TRUTH TABLE

| $G_m$ | $G_n$ | $OUTPUT_{m,n}$* |
|---|---|---|
| high | high | on |

*for example,
Grids $G_m$: −2 volts = low; +2 volts - high
Grids $G_n$: −5 volts = low; +20 volts = high This strictly logical behavior provides a distinct advantage over other matrix controlled devices, such as, liquid crystal displays. In those devices, control is based on the sharp voltage threshold of a material property of the light modulating or emitting material that is positioned between electrical control elements. The state of the material depends only on the voltage *difference* between the control elements. In the present invention, control is by the electrical activation of two juxtaposed electrical control elements where the potential of each with respect to the electron source must be within a certain range. The 256 grids $G_m$ are designed to be driven by relatively low TTL logic (up to 30 volts using ordinary open collector chips, or up to 80 volts using special display-driver chips) and are operated at low current levels. The binary number 256 was chosen because it represents a significant reduction in the number of necessary external interconnections leading to a compact package and is a convenient number of the design of the computer controlled drive circuitry. In the grid-grid multiplexing arrangement with the image data presented on the grid columns, the 16 rows of grids are energized sequentially one at a time. The imaging data, presented at the 256 column grids, determines which of the apertures in the energized row can pass electron current to the phosphor below. It is the phosphor on the anode which generates the useful light output pattern from the device, one row of excited elements at a time in succession. Since the system has only 16 rows, the associated circuits driving each row can be fabricated from discrete components if necessary, permitting but not necessarily requiring the use of tailored switching circuit designs that can deliver higher voltages and currents than currently available from integrated chips.

In operation, a conventional data source such as a computer sends appropriate video data to a multiplexer/controller constructed of conventional integrated circuit chips. The controller then sorts the video data input signals and with the proper timing, sends the correct signals to a column buffer/driver and to a row decoder also constructed of conventional integrated circuit chips. The row decoder keeps track of which row is active and signals the row buffer/drivers accordingly to deliver the proper row selection potential swing. Electrical power is supplied to the anode by way of a high voltage feed through 116.

If ony a few hundred volts are needed on the anode, the second grid can be eliminated and the anode segments themselves connected for form 16 rows, rather than be part of an equipotential surface as implied above; the row drivers would then switch the anodes rather than a second grid. This is the standard configuration found with vacuum fluorescent devices that are designed to operate at relatively low voltages. In this configuration, the drivers must supply the full operating anode current as well as the voltage swing. With two grids, only a relatively small grid current must be supplied. However, it has been found that in order to sufficiently expose a photoreceptor in a conventional xerographic machine relatively high anode voltage will be needed even with efficient light coupling optics. This makes the two-grid structure as shown in FIG. 1 preferable since the anode segments form a single equipotential anode operated at constant high voltage which does not have to be switched. The anode supply in this embodiment is introduced through a separate high voltage feed through spaced away from other components.

When the optical bar is operated in the preferred embodiment at a very high anode potential, the voltage swing needed for cutoff of either grid will be proportionately larger. This could cause severe operational problems for compact VF configurations where the grid-anode separation is minimal. However, the voltage swings needed for the control grids can be substantially reduced by placing equipotential screen grid 121 between conductive traces 119 and anode 112, effectively shielding the region near the grids from the anode accelerating fields. The control portion of the electrode structure then behaves as if the screen were the anode. Electrons gated to the screen pass through strategically located etched holes and are strongly accelerated to excite the phosphor coated anode which is at a much higher voltage. It should be understood that the generated light from bar 100 could be imaged on a photoreceptor either from the front or back surface. The grid structure itself could conceivably get in the way and prevent using the light emitted from the front of the device if its apertures were too small. But, in practice, apertures through which electrons pass are easily made to focus the electron beam on the target by applying an appropriate bias voltage. With this mechanism, larger openings are used in the control structure while still concentrating the electron beam on the target. The optimum configuration is a compromise with apertures large enough so that they do not block light yet small enough to permit low-voltage beam control.

A vacuum fluorescent device containing a large number of electronically controllable light sources in some fixed pattern is not by itself sufficient to make a useful print bar apparatus. In conventional vacuum fluorescent tubes, practical considerations limit the closet physical spacing of individually controlled light emitting segments to approximately 15–20 mils. With this limitation, placing all 4096 segments of print bar 100 in a single space at about 400 to the inch is precluded. However, if the segments are arranged in a rectangular array located 40 mils apart in both x and y directions forming an active area of 0.60 inches in width and 10.24 inches in length and the array is inclined by 40 mils with respect to the direction of photoreceptor motion, the minimum spacing requirements for the anodes as well as the grids and terminals are easily accommodated. Guiding the light from the rear of the light bar toward photosensitive surface or photoreceptor 210 is a fly's-eye lens 150 that provides both wide angle and high collimation effects.

In further reference to FIG. 2, the inside surface 140 of the apertures in insulating plate 120 and the area surrounding each aperture is coated with material that is slightly conductive, such as tin-indium oxide or a resistive cermet preparation, forming a layer with resistivity in the range of 10 to 500 thousand ohms per square. The function of this coating is to drain away any charge that may otherwise accumulate on exposed insulating surfaces within or near the apertures. If an aperture wall becomes charged, the electric field distribution is changed which greatly alters the electron trajectories through the aperture and therefore the structure's electron beam modulation characteristics. Spaces between traces on the surface of the control structure also have the slightly conducting coating to prevent charge accumulation there.

The conduction via the coating between adjacent traces on either surface, and between traces on opposite sides of the insulating plate through the apertures represents a resistive load to the grid drive circuits. The small current flow in the coating due to potential drops between grids does not affect electron trajectories or switching characteristics of the device in any way. However, the coating should be made as resistive as possible to minimize ohmic heating in the coating and limit the load seen by the drive circuits to a reasonable value.

Besides providing a leakage path to ground for stray charge, the resistive coating serves to stabilize the potential distribution in the interior of the apertures against the effects of space charge at high beam current and allows slightly larger apertures to be used with a given control voltage swing. In addition, tailoring the shape ofthe apertures, i.e., making them conical for example, provides some degree of control on their focussing properties because the field distribution in the interior of the aperture is modified.

The grid structure is electrically connected to the outside world by free-throughs 130 and 131 positioned along both edges of the tube in exactly the same way as the feed-through connections of standard VF tubes. These feed throughs can be metal fingers imbedded in the glass frit that forms the hermetic seal along the edge, or can be fabricated by thin film or thick film methods directly on the grid structure surface. The conductive screen electrode 121 that shields the conductive traces 119 from the anode can be fabricated from a thin metal foil etched with small holes located at the centers of the overlying grid plate in the same skewed pattern as the grid apertures. This is mounted on a spacer ring fastened to the grid substrate plate. At assembly, the screen is positioned so that the etched screen holes are coaxial with the corresponding grid apertures and is spot welded in place. The cathode-wire mounting hardware, which is attached on the opposite face of the grid substrate plate, is identical to that found in standard VF tubes except that more than three or four wires may be used. They may also be operated at higher temperature than the standard VF tube since their visibility to the human eye is irrelevant. Finally, the finished subassembly consisting of grid structure, anode screen and filaments is sealed in a vacuum envelope, baked evacuated and sealed using the same techniques and procedures as standard VF tubes.

In conclusion, an optical light bar is disclosed that receives electronically generated signals from a computer or other digital output sources and converts them into light transmissions that expose a photosensitive member in imagewise configuration. The light bar comprises wire filaments, first and second multiplexed/control grids, a skewed matrix of addressable phosphor coated anode elements mounted on an anode substrate, an equipotential screen grid positioned between the second grid and the anode elements, and an optional equipotential screen grid positioned between the cathode filaments and the first grid whereby as the phosphor coated elements are excited by electrons emitted from the filaments or cathodes through the control grids light is directed to the surface of a photosensitive member to expose it in imagewise configuration.

What is claimed is:

1. A control grid structure for controlling the flow of electrons along a trajectory, comprising:

an insulated substrate having a matrix of apertures therein;

a first series of conductive traces on an upper surface of said substrate aligned in columns;

a second series of conductive traces on a botton surface of said substrate aligned in rows, said first and second conductive traces being printed on said substrate to control surface potentials along the electron trajectory, and a resistive coating painted over the inside surface of said apertures, the area surrounding each aperture and in between said traces on said substrate to act as a voltage divider so that every point on the surfaces of said substrate is defined in voltages regardless of impinging electron current.

2. The control grid structure of claim 1, including screen means for reducing voltage swings required for gating said control grid structure and for adjusting focusing properties of said apertures.

3. The control grid structure of claim 2, wherein said screen means comprises a single screen positioned adjacent said bottom surface of said substrate.

4. The control grid structure of claim 1, including filament means; said filament means being attached directly to said substrate so that exact spacing to said substrate and apertures is maintained.

5. The control grid of claim 4, wherein said substrate is enclosed in a housing having hermetic seals with said first and second traces extending through said hermetic seals.

6. The control grid of claim 5, wherein said substrate is a lithium based black photosensitive glass.

7. A compact vacuum fluorescent printing device adapted for use in conjunction with a light sensitive recording media in order to create images from electronically generated data, comprising in combination:

a plurality of cathode filaments;

a multiplexed control grid, said grid comprising an insulated substrate having a matrix of holes therein, a series of conductive traces on upper and lower surfaces of said substrate to control surface potential along the path of electron emissions from said cathode filaments through said holes, and a resistive coating on said substrate of said control grid adapted to act as a voltage divider so that every point of the surfaces of said substrate is defined in voltage.

8. The vacuum fluorescent printing device of claim 7, including an equipotential screen position adjacent the lower surface of said substrate in order to reduce voltage swings needed for manipulating said control grid.

9. The vacuum fluorescent printing device of claim 7, including a matrix of addressable phosphor elements mounted on an anode means supported by an insulator such that as said phosphor elements are excited by said cathode filaments through the holes in said control grid a high resolution array of precisely defined light is generated and directed toward said light sensitive recording media.

10. The vacuum fluorescent printing device of claim 7, including a matrix of individual anodes mounted on an insulated support, said anodes having a covering of a fluorescent substance such that electrons allowed by said control grid to pass to said anodes from said filaments excite said fluorescent substance and causes said fluorescent substance to give off light generated and directed toward said light sensitive recording media in imagewise configuration.

11. The vacuum fluorescent printing device of claim 10, wherein said fluorescent substance is an electroluminescent phosphor.

12. The vacuum fluorescent printing device of claim 10, wherein said printing device has front and back surfaces and light is emitted from said fluorescent substance through said front surfaces.

13. The vacuum fluorescent printing device of claim 12, wherein light from said fluorescent substance is emitted through said back surface of said printing device.

14. The vacuum fluorescent printing device of claim 7, wherein said holes in said substrate are tailored in shape to modify the field distribution in the interior of the holes in order to provide some degree of control of their focussing properties.

15. The vacuum fluorescent printing device of claim 14, wherein said holes are conical in shape.

16. The vacuum fluorescent printing device of claim 7, wherein said light sensitive media is a photoreceptor.

* * * * *